United States Patent [19]

Ristuccia, Sr.

[11] Patent Number: 4,849,056

[45] Date of Patent: Jul. 18, 1989

[54] INDEX CARD FOR INDEX CARD FILE

[76] Inventor: John Ristuccia, Sr., 453 E. Susan La., Tempe, Ariz. 85281

[21] Appl. No.: 77,383

[22] Filed: Jul. 24, 1987

[51] Int. Cl.[4] ..... B42D 15/00

[52] U.S. Cl. ..... 402/79; 281/38; 402/500; 40/360

[58] Field of Search ..... 40/360, 377, 404; 283/62; 281/5, 38; 402/79, 500, 501

[56] References Cited

U.S. PATENT DOCUMENTS

| | | | |
|---|---|---|---|
| 3,930,700 | 1/1976 | Figueres | 402/79 X |
| 3,970,397 | 7/1976 | Armstrong | 402/79 |
| 4,636,179 | 1/1987 | Gentile et al. | 402/79 |
| 4,643,452 | 2/1987 | Chang | 402/500 X |
| 4,713,901 | 12/1987 | Wells et al. | 402/79 X |

*Primary Examiner*—Paul A. Bell

*Attorney, Agent, or Firm*—Don J. Flickinger; Jordan M. Meschkow

[57] ABSTRACT

An improved index card for use in conjunction with a rotary card file or the like includes means for displaying a business card. Slots, flaps, or adhesives may be used to secure the card to the index card. In one embodiment, the index card includes a frame which is folded over the business card to give a framed finished appearance. In some cases, the business card is removably secured to the index card, while in others, the business card is permanently secured to the index card.

16 Claims, 4 Drawing Sheets

FIG. 1
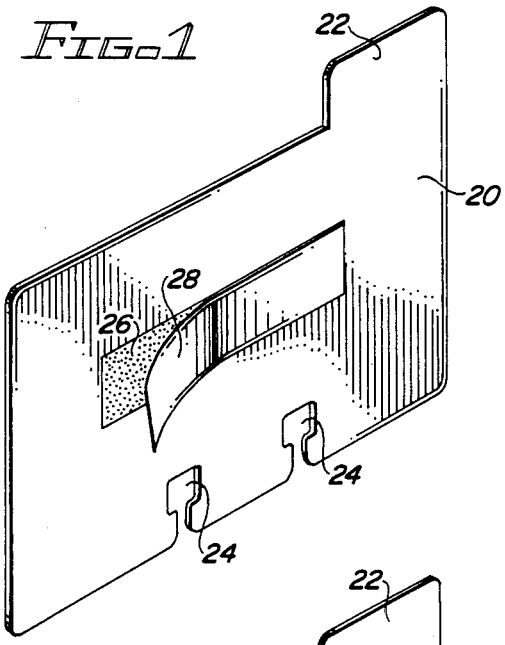
FIG. 4
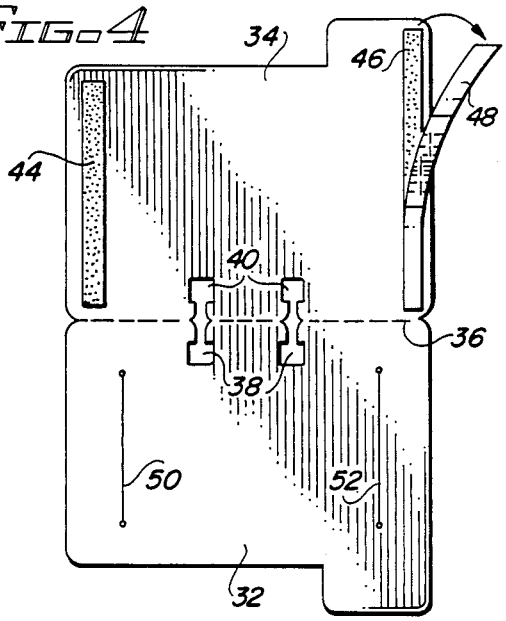
FIG. 2
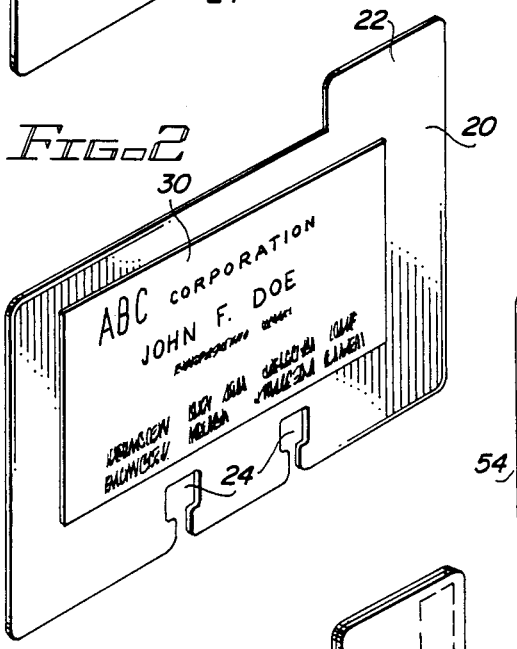
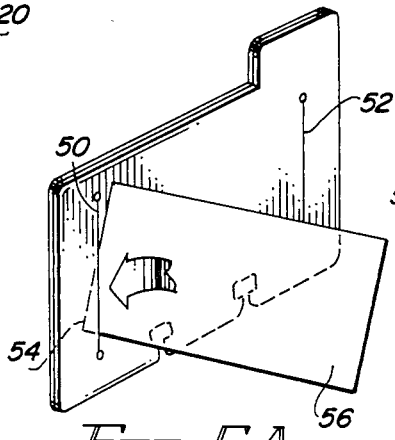
FIG. 5A
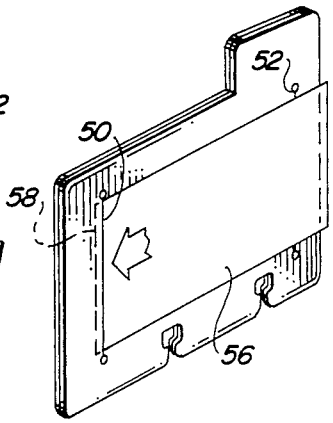
FIG. 5B
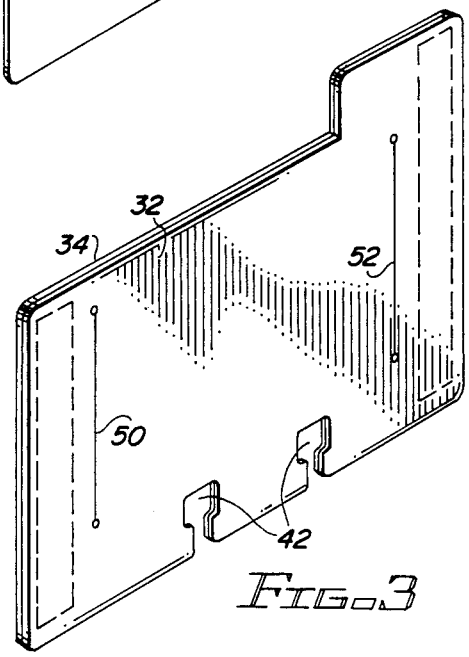
FIG. 3
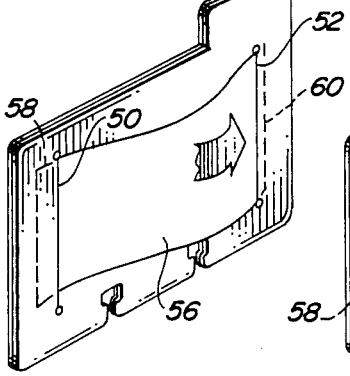
FIG. 5C
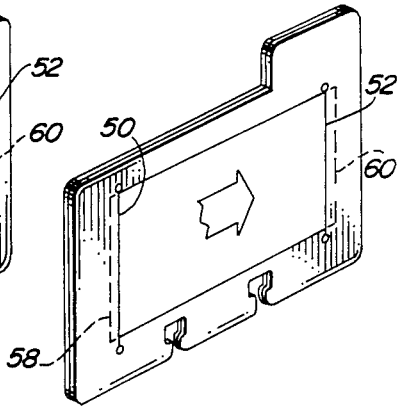
FIG. 5D FIG. 7
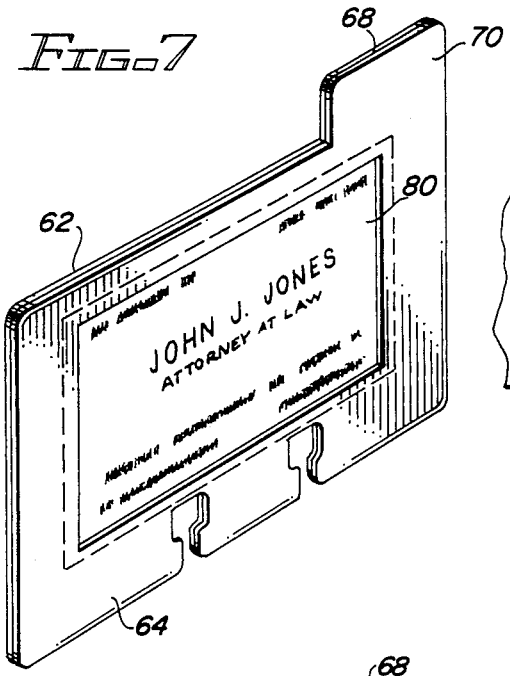
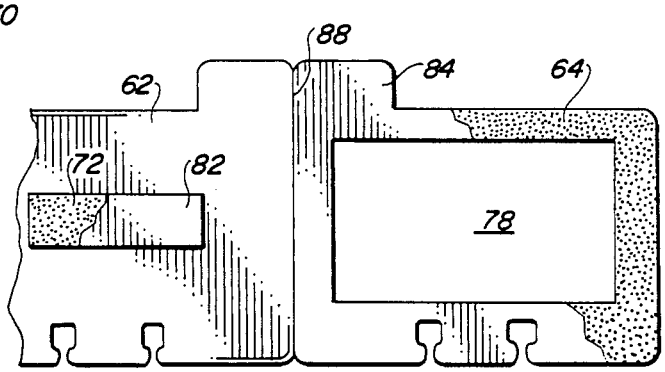
FIG. 9
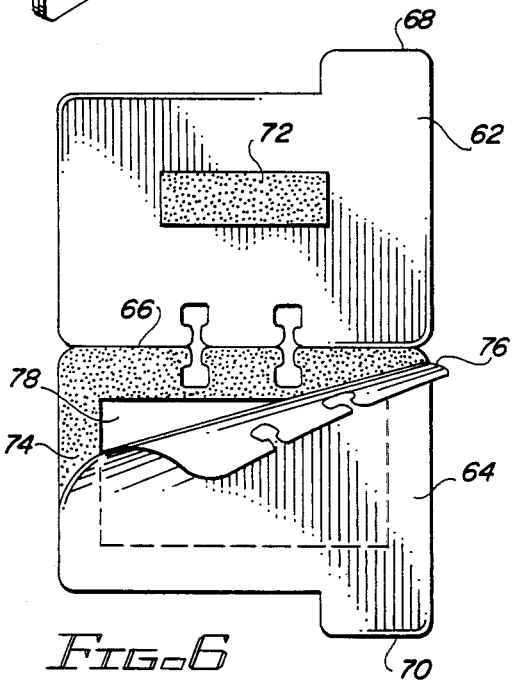
FIG. 6
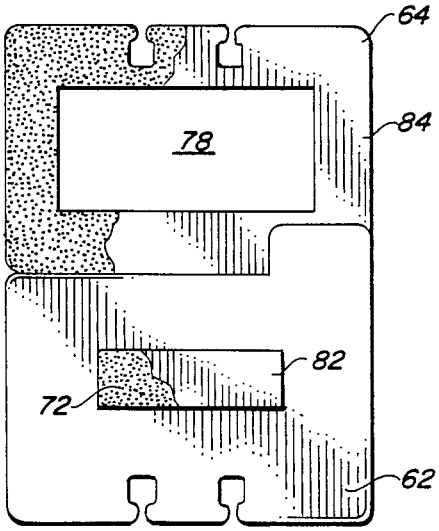
FIG. 10
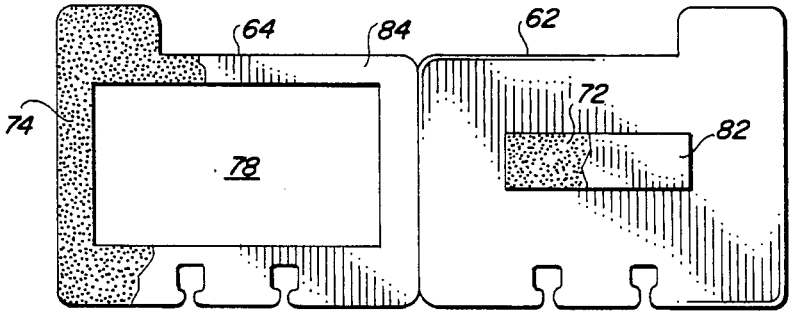
FIG. 8

INDEX CARD FOR INDEX CARD FILE

BACKGROUND OF THE INVENTION

This invention relates generally to an improved index card for index card files, and more particularly, to an index card for rotary files which is capable of receiving and/or securing a standard business card.

Index cards for use in conjunction with index card files such as rotary card files (e.g. of the type marketed under the name ROLADEX) are well known. Such cards include a main portion upon which a name, address, and/or telephone number may be typed or written. T-shaped slots (usually two) are cut into the lower edge of the main portion for receiving and accommodating the rails of the card file. The card may also include a tab extending upward from the main portion upon which may be typed or written generic information relating to the product or service offered by the individual or company identified on the main portion of the card. Based on the information on the tabs, the cards may be alphabetically ordered in the card file.

The information on the index card is usually manually typed or written. This is time consuming, and the individual recording the information on the card may commit one or more recording errors resulting in, for example, an incorrect address or telephone number appearing on the card. This may, in turn, result in further losses of time and unwanted expense and frustration due to delays in contacting the particular individual or company.

Considering the problem from another point of view, a common part of a businessman's approach to prospective customers or clients or between businessman is the transfer or exchange of business cards. The usual intent is that the business card convey sufficient information about the transferor so as to enable the transferee to make subsequent contact either by telephone, mail, fax, telex, etc. Unfortunately, business cards are often lost or misplaced thus reducing the possibility of subsequent or follow-on business.

SUMMARY OF THE INVENTION

It is an object of the present invention to provide an improved index card for use in conjunction with an index card file.

It is a further object of the present invention to provide an index card for use in conjunction with a rotary file, which index card is capable of receiving and securing a business card or like document.

It is still a further object of the present invention to provide an index card for use in conjunction with a rotary file, which index card is provided with a business card secured thereto.

Yet another object of the present invention is to provide a method for providing improved index cards for use in conjuntion with rotary card files.

Yet still another object of the present invention is to provide a method of providing personalized index cards for use in conjunction with rotary card files.

It is another object of the present invention to provide an apparatus for inexpensively transferring customized index cards for use in conjunction with rotary card files through the mail.

A further object of the present invention is to provide an improved index card for use in conjunction with a rotary file which index card includes means for securing a business card thereto.

A still further object of the present invention is to provide an improved index card for use in conjunction with a rotary file, which card may be used as an advertising medium.

According to a broad aspect of the invention there is provided an index card for displaying a business card or like document and capable of being used in conjunction with an index card file. The index card comprises at least a first major portion and business card receiving means formed in the first major portion for removably securing the business card to the first major portion.

According to a further aspect of the invention there is provided an index card for displaying a business card or like document and capable of being used in conjunction with an index card file. The index card comprises at least a first major portion and business card receiving means coupled to the first major portion for securing the business card to the first major portion.

According to a still further aspect of the invention there is provided an apparatus for transmitting a preprinted index card of the type which is used in conjunction with an index card holder. The apparatus comprises a sheet of paper-like material suitable for mailing and an index card pre-printed and formed integrally with the sheet and separable therefrom by means of a perforated outline in the shape of the index card on the sheet.

According to a still further aspect of the invention there is provided a method of providing personalized index cards of the type used in conjunction with an index card holder, the index card of the type including business card receiving and securing means. This method comprises obtaining the business card of a prospective customer, inserting the business card into the business card receiving means and displaying the index card including the business card to the customer.

BRIEF DESCRIPTION OF THE DRAWINGS

The above and other objects, features and advantages of the present invention will be more clearly understood from the following detailed description taken in conjunction with the accompanying drawings in which:

FIG. 1 illustrates a first embodiment of the inventive index card for use in conjunction with an index card file (e.g. a rotary card file);

FIG. 2 illustrates the embodiment shown in FIG. 1 with a business card attached thereto;

FIGS. 3 and 4 illustrates a second embodiment of the inventive improved index card for use in conjunction with rotary card file;

FIGS. 5A–5D illustrate how a standard business card is inserted into the index card of FIGS. 3 and 4;

FIGS. 6, 7, 8, 9 and 10 illustrate an alternate embodiment of the inventive index card for use in conjunction with an index card file;

DETAILED DESCRIPTION OF THE PREFERRED EMBODIMENT

Figure 11:
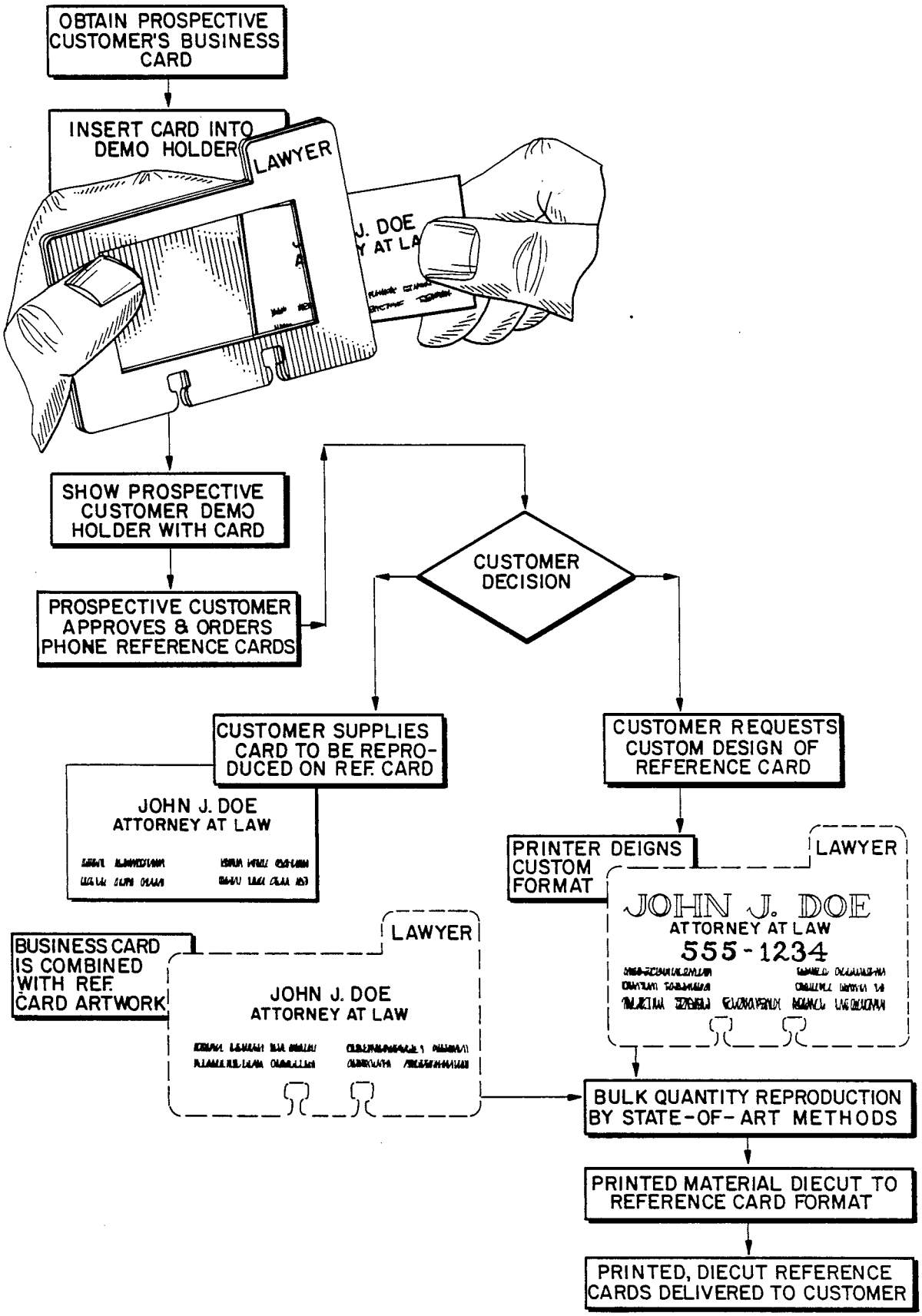
FIG. 11 is a block diagram illustrating the method by which custom index cards are manufactured in accordance with the teachings of the present invention.

FIG. 1 illustrates a first embodiment of the inventive index card for use in conjunction with an index card file such as a rotary card file. As can be seen, the card includes a main portion 20 and a tab portion 22 extending upward from the main portion. As stated previously, generic information describing the services or products offered by the individual or company identified on the card may be listed on the tab so as to assist in proper placement of the card within the card file. Also as stated previously, two T-shaped slots 24 are cut into the lower edge of the card to receive the rails of the file, upon which rails the index card will slide. Unlike the prior art, however, main portion 20 includes an adhesive layer 26 disposed thereon which is in turn provided with a protective backing 28. By first peeling off protective backing 28, a business card 30 may be secured to adhesive layer 26 such as is shown in FIG. 2. Broken line 19 may be used as a guide for placement of the business card.

It should be appreciated that this approach eliminates the possibility of recording errors when transposing information from the business card onto prior art index cards. In addition, it should be appreciated that the business card may be supplied to the prospective client or customer already affixed to the index in the form shown in FIG. 2. It is now only necessary for the prospective customer or client to insert the card into his rotary file. Tab portion 22 may be left blank or may already have pre-printed thereon the phraseology necessary for the proper filing of the card.

Referring now to FIGS. 3 and 4 there is shown an alternate embodiment of the inventive index card. The embodiment of FIGS. 3 and 4 actually comprises first and second major portions 32 and 34 which the shapes of which are the mirror images of each other as is shown in FIG. 4. Both portions are constructed from a single sheet and adapted to be folded along line 36. T-shaped slots 38 and main portion 32 and T-shaped slots 40 and main portion 34 are likewise mirror images and when folded will form T-shaped slots 40 which will receive the rails of the card file.

The surface of main portion 34 has provided thereon two adhesive layers 44 and 46 each of which is protected by a protective backing 48 (only one of which is shown). It should be also noted that main portion 32 is provided with first and second slots 50 and 52.

The apparatus is placed in its utilitarian form by first removing protective backings 48. The first and second major portions 32 and 34 are then folded onto each other along line 36 until major portion 32 contacts adhesive layers 44 and 46 which will cause main portions 32 and 34 to remain in their folded configuration A business card may then be removably secured to the index card by passing the ends of the business card through slots 50 and 52. This is more fully described in conjunction with FIGS. 5A–5D.

Referring first to FIG. 5A, it can be seen that a first corner 54 of business card 56 is inserted into slot 50. Business card 56 is urged into slot 50 until the entire left portion of the card 58 has been received into slot 50. business card 56 is bent outward so as to permit the right end of the business card 60 to be inserted into slot 52 such as is shown in FIG. 5C. Finally, as can be seen in FIG. 5D, both ends 58 and 60 have been inserted into slots 50 and 52 respectfully and the remainder of the business card 56 resides flush against the index card. It should be appreciated, that business card 56 may subsequently be removed and be replaced by an alternate business card.

FIG. 6 illustrates a second embodiment of the inventive index card for rotary card files. As can be seen from FIG. 6, this embodiment includes a first major portion 62 and a second major portion 64 foldable along line 66. Each major portion 62 and 64 includes tab sections 68 and 70 respectively. Located centrally to major portion 62 is a strip of adhesive 72 against which is urged the back surface of a business card. Second major portion 64 has disposed thereon a frame-like layer 74 of adhesive. A peel-of protective layer 76 not only protects adhesive layer 74 but also adhesive strip 72 when major portions 62 and 64 are folded on each other prior to use.

To utilize the embodiment shown in FIG. 7, the back surface of a business card is first urged against adhesive strip 72 in a desired position. Peel-of protective paper 76 is then removed, and major portion 64 is folded onto major portion 62.

Major portion 64 having a large opening 78 therein serves as a frame for business card 80 as is shown in FIG. 6. The business card 80 is not only secured by adhesive strip 72 but is also secured by the adhesive layer around the periphery of opening 78. The remainder of the adhesive on major portion 64 will engage that portion of major portion 62 around business card 80 and serve to hold major portions 64 and 62 together. Thus, the final product will appear as it does in FIG. 6.

The embodiments shown in FIGS. 8, 9 and 10 are very similar to that shown in FIGS. 6 and 7 with two exceptions. First, if desired, separate protective layers 82 and 84 may be used to protect the adhesive on major portions 62 and 64 respectively. Secondly, the embodiment shown in FIG. 8 is joined and foldable along edge 86, the embodiment shown in FIG. 9 is joined and foldable along edge 88, and the embodiment shown in FIG. 10 is joined and foldable along upper edge 90.

Figure 12A:
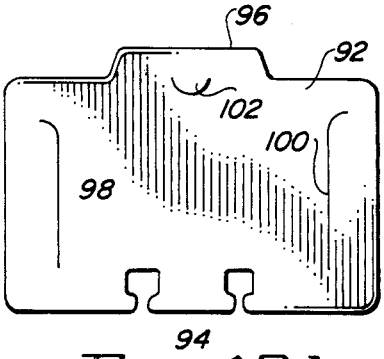
FIGS. 12A and 12B illustrate still another embodiment of the inventive index card.
Figure 12B:
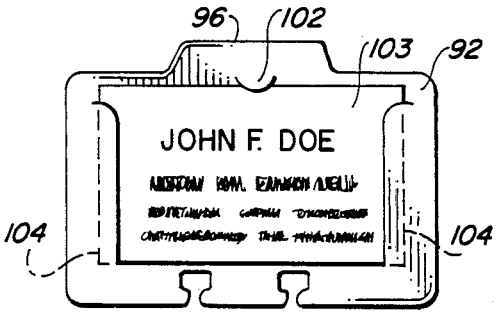

FIGS. 12A and 12B illustrate yet another embodiment of the inventive index card. As can be seen from FIG. 12A, it includes a major portion 92 having first and second T-shaped slots 94 and a centrally located upper tab 96. First, second and third slots are cut through major portion 92 toform first, second and third flaps 98, 100 and 102. Referring now to FIG. 12B, a business card 102 may be secured onto major portion 92 by first inserting corners 104 of the business card beneath the flaps and slide in card 102 down. By then tilting tab portion 96 downward, flap 102 will raise allowing the upper edge of card 102 to slip beneath fflap 102. Releasing tab 106 will then secure the business card in place. The entire business card may then be inserted into the rotary file.

Figure 14A:
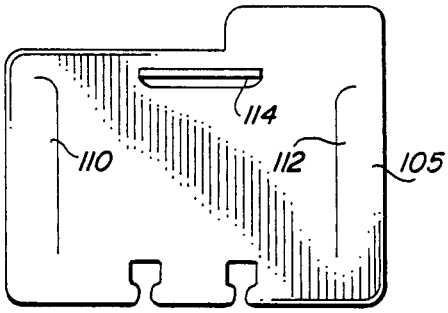
FIGS. 13, 14A and 14B illustrate still a further embodiment of the inventive index card.
Figure 14B:
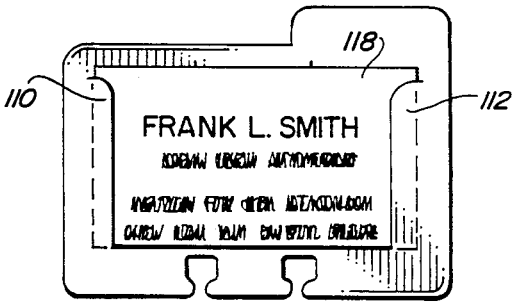
Figure 13:
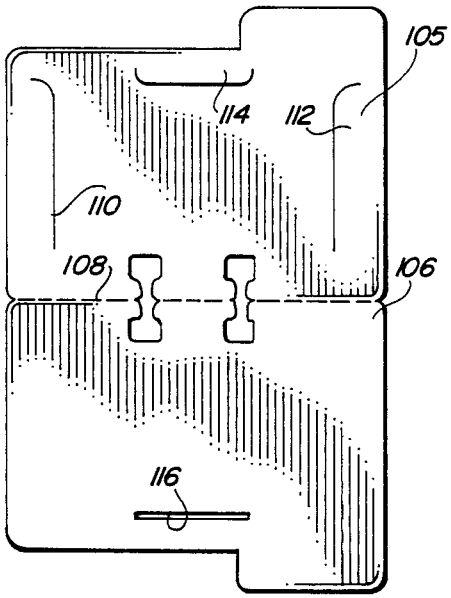

FIGS. 13, 14A, and 14B illustrate yet another embodiment. Referring to FIG. 13, the index card comprises first and second major portions 104 and 106 foldable on each other along line 108. The first major portion 104 includes three slots for forming flaps 110, 112 and 114 respectively. Major portion 116 includes a narrow slot 116. When major portion 106 is folded so as to engage the back surface of major portion 104, flap 114 is inserted through slot 116 to secure major portions 104 and 106 together. The resulting configuration is shown in FIG. 14A. A business card 118 may then be inserted behind flaps 110 and 112 as was the case in the embodiment shown in FIGS. 12A and 12B.

Figure 15:
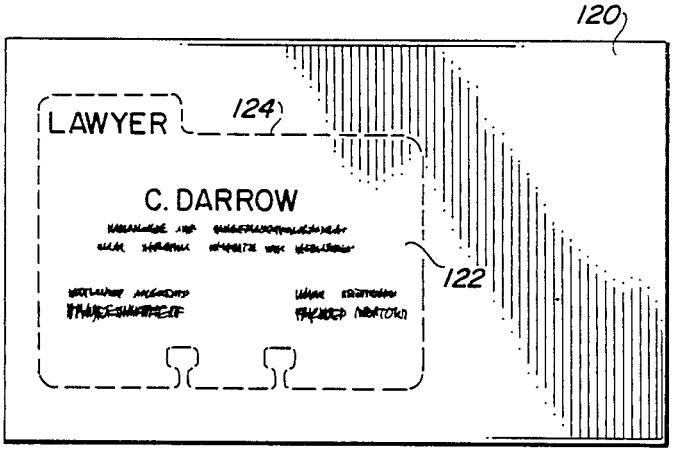
FIG. 15 illustrates yet another embodiment of the instant invention.

As already discussed, it would be desirable to provide pre-printed index cards for rotary card files as an advertising medium. FIG. 15 illustrates one approach for accomplishing this. A card 120, for example the size of a post card, is provided with a pre-printed rotary file index card 122 connected to card 120 by means of perforated outline 124. The index card 122 may be simply torn from card 120 and placed directly in the addressee's rotary card file.

FIG. 11 is a block diagram illustrating the method by which custom made index cards for rotary files may be marketed. First, as can be seen a vendor of the inventive index cards first obtains a prospective customer's business card and inserts it into a demonstration index card in accordance with the previous discussion. The demonstration index card containing the prospective customer's business card is then shown to the prospective customer. If the prospective customer approves, he may order the customized index cards in one of two ways. First, the customer may supply his business card which is then reproduced on the inventive index card. Second, the customer may desire that the reference card be custom designed in which case a printer might design the custom format. Alternately, the business card may be combined with art work on the inventive index card. In either case, the customized index card is reproduced in bulk quantity by state-of-the-art methods. The printed material is die cut to the reference card format and delivered to the customer.

Thus, there has been described an improved index card for use in conjunction with a rotary card file, which index card is configured so as to receive and secure a business card or like document. Alternately, a customized index card may be supplied to the customer. In addition, it has been demonstrated how the index card of the present invention may be utilized as an advertising medium.

The above description is given by way of example only. Changes in form and details may be made by one skilled in the art without departing from the scope of the invention as defined by the appended claims.

I claim:

1. An index card for displaying a business card and for use in conjunction with an index card file, said index card comprising:

a first major portion having an edge;

business card receiving means carried by said first major portion for securing said business card thereto;

a second major portion couple along said edge to said first major portion and in mirror image relationship therewith for folding along said edge onto said first major portion to form a folded configuration exposedly displaying said business card; and attachment means for connecting said folded configuration to said index card file.

2. An index card according to claim 1 wherein said business card has first and second ends and wherein said business card receiving means includes first and second substantially parallel slots formed proximate opposite sides of said index card for receiving said first and second ends respectively of said business card.

3. An index card according to claim 1 further comprising a tab portion extending upward from said first major portion.

4. An index card according to claim 1 wherein said attachment means comprises at least one T-shaped slot.

5. An index card according to claim 1 further comprising securing means for maintaining said first and second major portions in said folded relationship.

6. An index card according to claim 5 wherein said securing means comprises adhesive means attached to one of said major portions for engaging and securing the other of said major portions when said second major portion is folded onto said first major portion.

7. An index card according to claim 6 further comprising first protective means for covering said adhesive prior to folding and removable therefrom.

8. An index card according to claim 5, wherein said securing means includes:

a slat formed in one of said major portions; and a flap carried by the other of said major portions for engaging said slot when said second major portion is folded onto said first major portion.

9. An index card according to claim 1 wherein said business card includes first and second ends and wherein said business card receiving means includes first and second opposed slots at opposite ends of said index card forming first and second flaps under which the first and second ends respectively of said business card are received.

10. An index card according to claim 1 wherein said business card receiving means includes adhesive means coupled to a central portion of said first major portion.

11. An index card according to claim 10 further comprising a protective layer on said adhesive means which is removable prior to engagement with said business card.

12. An index card according to claim 10 further comprising a second major portion having a common edge with said first major portion and in mirror image forming relationship therewith.

13. An index card according to claim 12 wherein said second major portion has a central opening therein forming a window so as to render said second major portion frame-like in appearance.

14. An index card according to claim 13 further comprising adhesive means disposed on said frame-like structure for engaging said first major portion so as to maintain said first and second major portions in a folded relationship.

15. An index card according to claim 14 wherein said frame-like structure of said second major portion frames a business card secured to said first adhesive means when said second major portion is folded onto said first major portion.

16. An index card according to claim 15 further comprising protective means covering said adhesive means on said second major portion and removable therefrom.

* * * * *